US009593519B2

(12) United States Patent
Branco Teixeira et al.

(10) Patent No.: US 9,593,519 B2
(45) Date of Patent: Mar. 14, 2017

(54) MAGNETIC LEVITATION SYSTEM FOR DOORS AND WINDOWS

(71) Applicant: HIPERJANELAS LDA, Perafita (PT)

(72) Inventors: Rui Fernando Branco Teixeira, Fornelos (PT); Carla Sofia Carvalho Da Rocha, S. Félix Da Marinha (PT); Senen Lanceros Méndez, Braga (PT); Vítor Manuel Gomes Correia, Estela (PT)

(73) Assignee: HIPERJANELAS LDA, Perafita (PT)

( * ) Notice: Subject to any disclaimer, the term of this patent is extended or adjusted under 35 U.S.C. 154(b) by 0 days.

(21) Appl. No.: 14/889,116

(22) PCT Filed: May 6, 2014

(86) PCT No.: PCT/PT2014/000024

§ 371 (c)(1),
(2) Date: Nov. 4, 2015

(87) PCT Pub. No.: WO2014/182186

PCT Pub. Date: Nov. 13, 2014

(65) Prior Publication Data

US 2016/0069116 A1 Mar. 10, 2016

(30) Foreign Application Priority Data

May 6, 2013 (PT) ..... 106928

(51) Int. Cl.
*E05D 15/00* (2006.01)
*E05D 15/06* (2006.01)
(Continued)

(52) U.S. Cl.
CPC ..... *E05D 15/0686* (2013.01); *E05D 15/06* (2013.01); *E05F 15/60* (2015.01);
(Continued)

(58) Field of Classification Search
CPC ..... E05D 15/0686; E05D 15/06; E05D 15/60; E05D 15/70; E05D 2015/0695
See application file for complete search history.

(56) References Cited

U.S. PATENT DOCUMENTS 3,334,442 A * 8/1967 Boettcher ..... E05D 15/0621 16/87 R
3,346,993 A * 10/1967 Johnson ..... E05D 15/066 16/320
(Continued)

FOREIGN PATENT DOCUMENTS

DE 10 2008 023511 A1 11/2009
JP 03221687 * 10/1991
(Continued)

OTHER PUBLICATIONS

Abstract of JP 03244777 A.*
(Continued)

*Primary Examiner* — Katherine Mitchell
*Assistant Examiner* — Scott Denion
(74) *Attorney, Agent, or Firm* — Maier & Maier, PLLC

(57) ABSTRACT

A magnetic levitation system for sliding door and window, includes at least a movable module for the lower part of the sliding door and window which includes one or more permanent magnets; several fixed modules for the lower part of the frame of the sliding door and window, which includes one or more electromagnets to produce a variable repulsive magnetic field of the magnetic field of said magnets of the movable module. It has the advantage of eliminating the friction, mechanical wear and noise associated to the sliding, allowing, when deactivated, a greater air and water tightness and terminal and acoustic insulation, allowing the electromagnetic closure or locking of the door and window, increasing the security, and as is a modular system its operation and construction are simpler and more economical.

14 Claims, 5 Drawing Sheets

(51) Int. Cl.
*E05F 15/60* (2015.01)
*E05F 15/70* (2015.01)

(52) U.S. Cl.
CPC ..... *E05F 15/70* (2015.01); *E05D 2015/0695* (2013.01); *E05Y 2201/462* (2013.01); *E05Y 2201/604* (2013.01); *E05Y 2400/32* (2013.01)

(56) References Cited

U.S. PATENT DOCUMENTS

| | | | | |
|---|---|---|---|---|
| 4,575,966 | A * | 3/1986 | Gerritsen | E05D 15/0682 49/209 |
| 6,543,581 | B1 * | 4/2003 | Durand | B66B 13/08 187/316 |
| 7,013,605 | B2 * | 3/2006 | Zhou | E05F 15/60 187/315 |
| 8,020,346 | B2 * | 9/2011 | Singiser | E05D 15/0682 49/360 |
| 8,132,653 | B2 * | 3/2012 | Flynn | B66B 13/08 187/313 |
| 8,474,185 | B2 * | 7/2013 | Busch | E05F 15/652 49/358 |
| 8,646,211 | B2 * | 2/2014 | Rosenbeck-Mortensen | E05D 15/0621 49/404 |
| 2003/0221374 | A9 * | 12/2003 | Zhou | E05F 15/60 52/30 |
| 2006/0090401 | A1 * | 5/2006 | Berry | E06B 3/80 49/409 |
| 2008/0100152 | A1 * | 5/2008 | Busch | E05F 15/60 310/14 |
| 2008/0209813 | A1 * | 9/2008 | Haab | E05D 15/0621 49/360 |
| 2009/0044916 | A1 * | 2/2009 | Singiser | E05D 15/0682 160/201 |
| 2012/0255229 | A1 * | 10/2012 | Rosenbeck-Mortensen | E05D 15/0621 49/194 |
| 2014/0016885 | A1 * | 1/2014 | Rainis | E05D 15/06 384/8 |

FOREIGN PATENT DOCUMENTS

| | | | |
|---|---|---|---|
| WO | 97/42389 | A1 | 11/1997 |
| WO | 2012/101624 | A1 | 8/2012 |

OTHER PUBLICATIONS

International Search Report dated Aug. 12, 2014 from corresponding International Application No. PCT/PT2014/000024; 2 pgs.

Singapore Notice to Grant and Supplementary Examination Report dated Mar. 7, 2016, in connection with corresponding SG Application No. 11201508295T (4 pgs.).

* cited by examiner

MAGNETIC LEVITATION SYSTEM FOR DOORS AND WINDOWS

TECHNICAL FIELD

The present invention refers to a magnetic levitation or suspension system for doors and windows, in particular, for sliding using the repulsion electronically controlled between electromagnets and permanent magnets.

BACKGROUND

Since its invention that the sliding doors or windows present the same operating principle, based on a set of small rollers applied on the base of the door and window, which allow sliding along a guiding rail. This principle results in a greater effort to move the window, due to the great friction force produced by this mechanism, to the extent that, by the structural requirements, the diameter of the rollers used is quite reduced, which results in a greater friction force and therefore a higher inertia to the movement of the system, which results in the necessity of the application of a considerable force to proceed to the movement of the door and window. It is to be noted that, therefore, for doors or windows of greater dimensions, the required force for its movement increases considerably.

On the other hand, this method obliges to a permanent mechanical contact between the door and window and the support guiding rail through the rollers, which implies a constant charge over the rollers which enable the sliding. Hence, this constant high charge causes a high wear over the several mechanical components which compose this system, which leads to a constant need of maintenance of the system and to a limited useful life.

Due to the mechanical contact that exists between the several components, it is further generated a noise associated to the movement of the door and window. This noise could be cumbersome, or even unpleasant, mainly when it is registered a high wear of the sliding system.

For improving the performance of the door and window sliding system, several technologies have been developed, which are based on new roller and guiding rails configurations which allow in some way to reduce the friction, as well as the inertia of the system, giving rise, therefore, to systems which take better advantage of the force made by the user.

Currently, there are in other technical fields which allow to considerably reducing the friction associated to the movement, as is the case of the magnetic systems, which are applied on the magnetic levitation trains, or on nanopositioning systems. Despite this, the traditional solution of the sliding systems is based on rollers, which are used in all the doors or windows sliding systems.

The invention presented here solves the problems described above, differently from the prior art (U.S. Pat. No. 7,568,848B2, Ser. No. 03/741,613, U.S. Pat. No. 7,889,037B2, Ser. No. KR100788883, Ser. No. CN1928313) as explained below.

In relation to the U.S. Pat. No. 7,568,848B2, as set forth in its claims, it relates to a sliding structure for a lenses protection door for a digital camera, so it is not enclosed in the scope of the present invention. In addition to the application scope, the system described in this patent is based uniquely in a set of permanent magnets that give rise to the opening of the protection door and its respective closure, but not proceeding to its levitation. In this way, this system presents friction in the guiding system, since in this case they are not magnetic.

In relation to the U.S. patent Ser. No. 03/741,613, and according to its claims, it describes an electromagnetic levitation guiding system for objects. In this case, its field of application scope does not correspond to the scope of the present invention. The object of said patent is uniquely based on electromagnets, both for the structure which is levitated, and for the guiding structure. In this way it implies the need electric power supply for both parts which constitute broadly the levitation system, which corresponds for the door and window sliding systems to a great difficulty of execution.

On the other hand, the methodology described in said patent is not completely operational to application in doors or windows sliding systems, since, in the way that the system is described, there is a set of lateral forces produced by the electromagnets which are not duly compensated, which would cause a lateral displacement of the guide in suspension, placing the magnetic poles in balance and the corresponding non levitation of the body.

The above system is uniquely based on electromagnets; therefore it presents a higher energy cluster, when compared with the system of the present invention.

Referring to U.S. Pat. No. 7,889,037B2, this discloses a sliding magnetic structure applied to a mobile phone. In this case the disclosed levitation system is not enclosed in the same technical field as the present invention.

The operating method disclosed in said patent is uniquely based on a set of permanent magnets, being assumed that the body mass to levitate is always the same, which is not the case in doors or windows sliding systems, since the mass of the doors or windows vary according to its use.

On the other hand, the guiding system configuration disclosed does not allow the separation of the two parts, which for the door and window sliding systems means a great difficulty of implementation or even making it impossible.

The patent KR100788883 discloses a sliding door motorized system, in which the door is fixed by means of a mechanical transmission chain, which chain is moved through an engine. The system is comprised of an L profile which does not support the lateral forces produced by the permanent magnet and electromagnet, which produce a large lateral friction force and requires a set of rollers to help the sliding, which means a great wear of the mechanical parts, and a noise and friction increase.

In CN1928313 is disclosed a system for use in a two-wing revolution door driven by magnetic levitation and arc motor, comprising magnetic bearing and arc motor driving equipment. A permanent-magnet is assembled on outer ring of revolution door and the permanent-magnet and the electromagnet are assembled on inner ring. It is important to emphasize that this system presents a set of ball bearings in the door axle, where the door is supported, which axle is the same axle of the ring.

All the solutions disclosed above, none of them refers to a window/door sliding system by magnetic levitation, based only on magnets and electromagnets.

DESCRIPTION OF THE INVENTION

The present invention intends to solve the problems set forth in the description of the above mentioned documents, especially of the traditional sliding systems, the invention being used in the movement by levitation of all types of sliding doors or windows, with the different sizes and formats, which allows:

a) To eliminate the friction associated to the movement of the sliding system and the corresponding required effort for the sliding movement of the door and window system by the user;

b) To suppress the mechanical wear caused by the interaction of the mechanical components;

c) To eliminate the noise produced by the sliding system;

d) To mount a modular system, which enables to achieve the required dimensions for each application, rendering in this way the system an all purpose system in order to be able to be applied in very different situations;

e) The security of the closure or locking of the door and window increases with the electromagnetic system implemented for the levitation;

f) Due to its geometry is achieved a greater tightness to the air and to the water and a greater thermal and acoustic insulation of the door and window assembly when the door and window is in the rest condition.

The present invention relates to an electromagnetic levitation and sliding system for sliding doors or windows, and it objective is to reduce the required effort for the displacement of the doors or windows by its user, as well as to suppress the mechanical wear which occurs in traditional systems.

As an electromagnetic system, it enables to effectuate the locking of the doors or windows, when these are in the rest condition.

The sliding system is particularly indicated for all kind of sliding doors or windows. The levitation system enables an easier sliding due to application of human force or other kind of force.

However, it can be used in other applications wherein there is the need to lift other objects or any body and proceed with its sliding with smaller effort, the movement caused by human force, electric, hydraulic, pneumatic force or others forces.

It is disclosed a magnetic levitation system for sliding door and window, characterized in that it comprises, at least, a movable module for the lower part of the sliding door and window, comprising one or more permanent magnets; several fixed modules for the lower part of the frame of the sliding door and window, each one comprising one or more electromagnets for producing a variable repulsive magnetic field of the magnetic field of said magnets of the movable module.

In a preferred embodiment, the fixed module comprises in addition one or more permanent magnets which magnetic field is oriented in repulsion of the magnetic field from the magnets of the movable module.

The movable module and the fixed module can be implemented with other geometries, such as in U or related, which present a magnetic repulsion effect.

In a preferred embodiment, the fixed module has an inverted V profile, in particular a truncated inverted V profile.

In a preferred embodiment, the magnets of the movable module are arranged in two lateral parallel rows along the lower part of the sliding door and window and with the same magnetic direction.

In a preferred embodiment, the fixed module has a V profile, particularly a V truncated profile.

In a preferred embodiment, the electromagnets, or the electromagnets and magnets, of the fixed module, are arranged in two lateral parallel rows along the lower part of the frame of the sliding door and window and with the same magnetic direction.

In a preferred embodiment, of the two said lines of the fixed module, one is of electromagnets and the other is of magnets.

In a preferred embodiment, the magnetic poles of said rows of the fixed module, for repulsion of the movable module, are arranged with an inner angle in relation to the vertical axis of the sliding door and window.

In a preferred embodiment, the magnetic poles of said rows of the movable module, for repulsion of the fixed module, are arranged with an outer angle in relation to the vertical axis of the sliding door and window.

In a preferred embodiment, said angle varies between 30° and 60° particularly 45° in relation to the horizontal axis.

A preferred embodiment comprises a sensor for measuring the clearance between the sliding door and window and the frame of the sliding door and window, and comprises a control unit designed to maintain a predefined clearance between the sliding door and window and the frame of the sliding door and window through the control of the power supplied to said electromagnets.

In a preferred embodiment, the control unit is designed to deactivate the electromagnets when the movement of the sliding door and window it is not necessary or when it is intended the locking of the siding of the sliding door and window.

In a preferred embodiment, the control unit is designed only to activate the electromagnets when the fixed module and the movable module are overlapped.

In a preferred embodiment, the control unit is designed to activate the electromagnets of the fixed module for the inversion of its polarity so that the repulsion is suppressed, when it is required the locking of the sliding of the sliding door and window.

A preferred embodiment comprises a plurality of said fixed modules and/or a plurality of said movable modules.

In a preferred embodiment, said modules are interconnected by a data web.

In a preferred embodiment, the levitation system, its data web and its control unit is designed to activate and deactivate the electromagnets, module by module.

BRIEF DESCRIPTION OF THE DRAWINGS

The previously indicated features, as well as further relevant features, will be more apparent, from the following exemplificative description of the present invention, which is not intend to limit its object, made with reference to the accompanying drawings, in which.

DETAILED DESCRIPTION

The present invention refers to an electromagnetic levitation and sliding system for sliding doors or windows, which object is to reduce the required effort to displace the doors or windows by the user, as well as to eliminate the mechanical wear which occurs in traditional systems.

The electromagnetic system enables the locking of the doors or windows, when there are in rest condition.

Figure 1A:
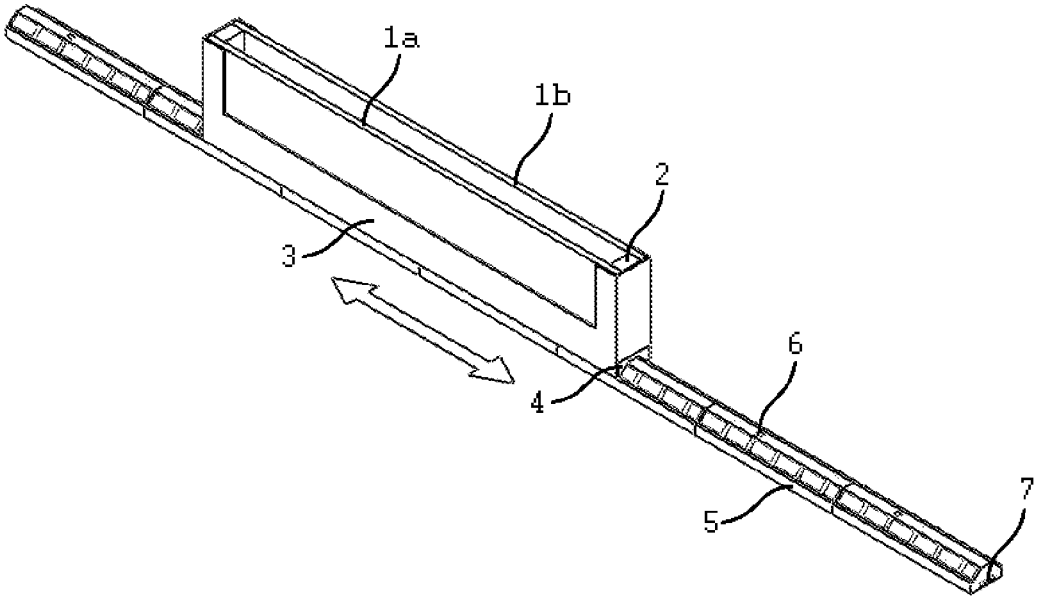
FIG. 1A is a schematic perspective view which illustrates a sliding door and window lower system where it is installed the magnetic sliding structure corresponding to the present invention.

As FIG. 1A shows, which is the lower schematic perspective of a sliding door and window 1*a*, 1*b*, 2, the door and window being comprised by a frame 3 and its respective window glasses defined by the parts 1*a*, 1*b* and 2. The levitation system disclosed is comprised by set of electromagnetic modules 5, which produce a variable magnetic field, comprising the sliding sill of the door and window, the electromagnetic modules 5 being arranged in series.

The length of the sliding sill is defined by the sum of the lengths of the electromagnetic modules used, which allows to obtain any working dimension for the door and window.

Figure 1B:
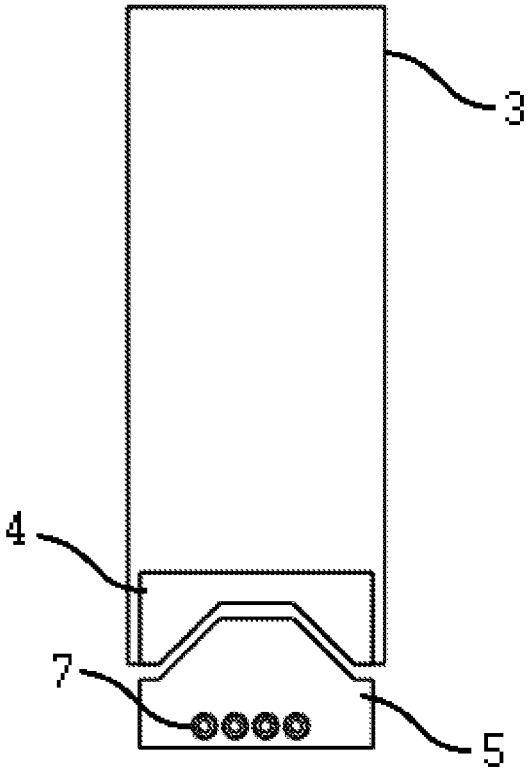
FIG. 1B is a schematic side view which illustrates the door and window sliding system of FIG. 1A.

The levitation system is further comprised by a set of magnetic modules 4, in which they are installed in the lower end of the frame 3 of the door and window, in which, they create a permanent and constant magnetic field, as it is possible to see with greater detail in FIG. 1B. As in the previous case of the electromagnetic modules 5, there are also used several magnetic modules 4, to form the frame 3 with a width identical to the width of the door and window.

From the FIG. 1B, which is to a schematic side view of the door and window, can be seen that by using this electromagnetic levitation and sliding system, there is no contact between the modules 4 and 5, when occurs the sliding of the door and window. The clearance between the two modules 4 and 5 is variable according to the features of the door and window where these parts are applied, being able to vary between 1 and 10 mm. In the case in which the door and window is in the rest condition, the fix module does not produces any magnetic field, which brings the window to the rest condition in the sill. As the two modules 4 and 5 fit perfectly, the preferred embodiment, visible in FIG. 1B and FIG. 2, allows to make a water, wind and sound sealing.

Figure 3:
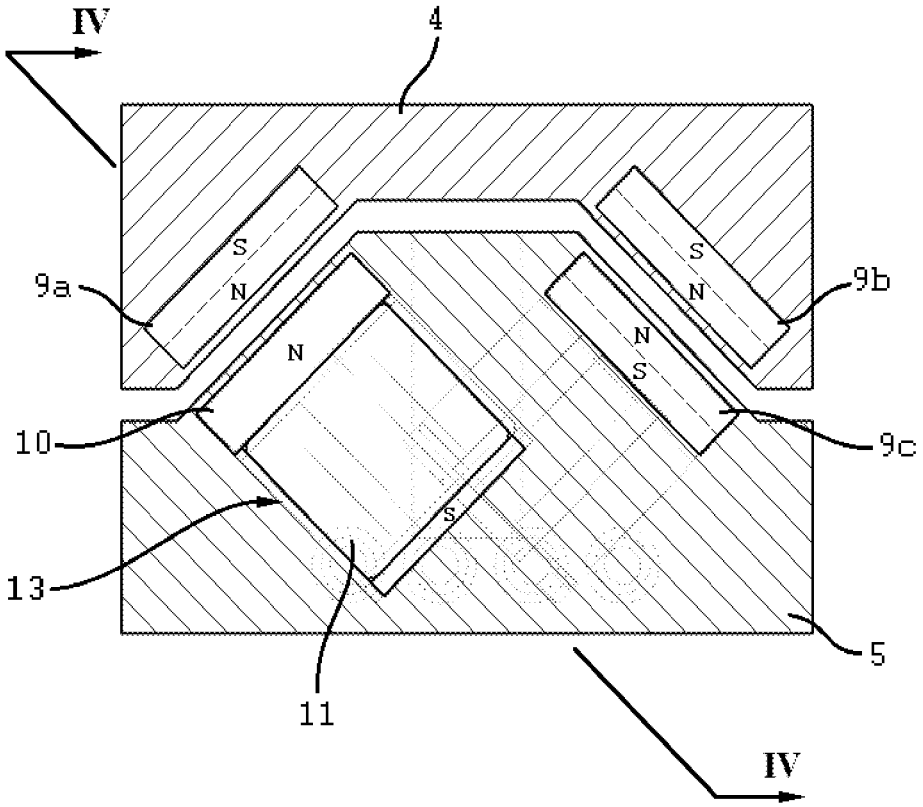
FIG. 3 is a sectional view taken on the line III-III of the magnetic sliding modules of FIG. 2.
Figure 4:
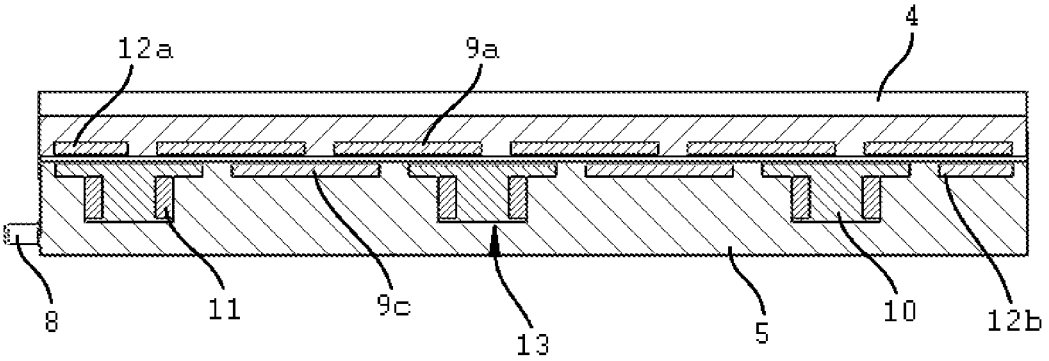
FIG. 4 is a sectional view taken on the line IV-IV of the magnetic sliding modules of FIG. 3.

The permanent magnetic field is produced by the use of permanent magnets 9*a*, 9*b* and 12*a*, in particular made of Neodymium, as is shown in FIG. 3 and FIG. 4, being able to be used other similar materials, which enable to generate magnetic fields in an axial direction, which are sufficiently strong allowing the levitation of the door and window. Each module is preferably comprised by two rows of permanent magnets, all placed with the same magnetic orientation, for example, the lower end being the north magnetic pole and the upper end being the south as is described in FIG. 3. In a preferred embodiment the ends of the magnets present an orientation of 45° in relation to the horizontal axis, as is represented in FIG. 3, this angle being able to vary between 30° and 60° according with the dimensions and features of the door and window where this system will be implemented.

In each line there are placed, in a preferred embodiment, six permanent magnets with a clearance between the magnets which could vary between 1 and 10 mm, according to the features of the doors or windows. The dimension, the format and the number of magnets per each row can also vary, allowing obtaining modules with different dimensions.

The shape of permanent magnets 9*a*, 9*b* and 12*a* is parallelepiped, but they can present other shapes, its dimensions being comprised between 10 and 40 mm of length, 5 to 25 mm of width and 1 to 8 mm of thickness, these dimensions being defined according to the weigh of the door and window to be levitated.

In a preferred embodiment the variable magnetic field is produced by a set of electromagnets 13, which are comprised by a ferromagnetic core 10 and a coil 11 made copper wires, it being incorporated a set of permanent magnets 9*c* arranged in an intercalated way, along two rows on each module 5, as described in FIG. 3 and FIG. 4. The material that constitutes the permanent magnet 9*c* and 12*b* is preferably the same described for the permanent magnets 9*a*, 9*b* and 12*a*.

In a preferred embodiment, on each row there are placed three electromagnets 13 and two permanent magnets 9*c* and 12*a*, these being also intercalated between the two lines, allowing a reduction in the energy consumption for the levitation and sliding system, as can be seen through the FIG. 3 and FIG. 4. The rate of electromagnets and permanents magnets could vary according to the requirements for the magnetic field to be produced, as well as the total number of permanent magnets and electromagnets and the clearance between them depends on the length of the module 5, as occurs to the module 4.

In a preferred embodiment the form and dimensions of the upper surface of the ferromagnetic core 10 is identical to corresponding surfaces of the permanent magnets. The upper end of the ferromagnetic core 10 corresponds to the north magnetic pole, as well as an upper end of the permanent magnets 9*c* and 12*b* also corresponds to the north magnetic pole. In this way, it is created a repulsion force between the magnetic field created by the module 5 and the magnetic field created by the module 4, which results in the levitation of the module 4 and, therefore, of the door and window. In a similar way, the system can be carried out by inverting the referred magnetic poles.

The material which constitutes the body of the magnetic module 4 and the fixed module 5, in which there are inserted all the components which effect the levitation 9*a* and 9*b*, will be plastic or metal without ferromagnetic proprieties, which fulfils the requirements of the system.

Figure 5:
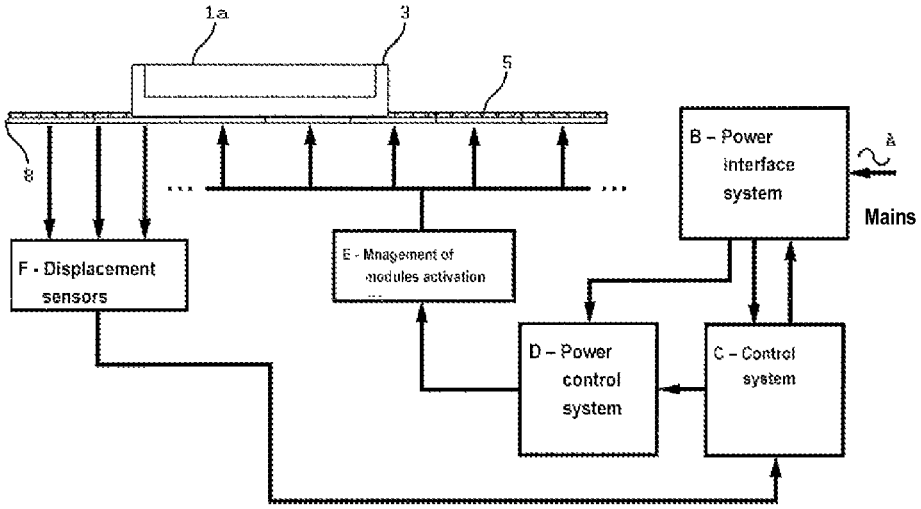
FIG. 5 is a schematic block diagram of the electronic control system which makes the activation of the magnetic sliding modules.

In the described device it is possible to control the intensity of the magnetic field produced by the module 5, by adjusting the electric current which actuates in the electromagnets 13. In this way, it is possible to control the elevation of the window, with an electronic control system which is illustrated in FIG. 5.

The mains A supplies electrical power to the system, the levels of voltage being changed by the power interface system B, to adequate values for the actuation of the electromagnets and electric supply of the system as a all.

Figure 2:
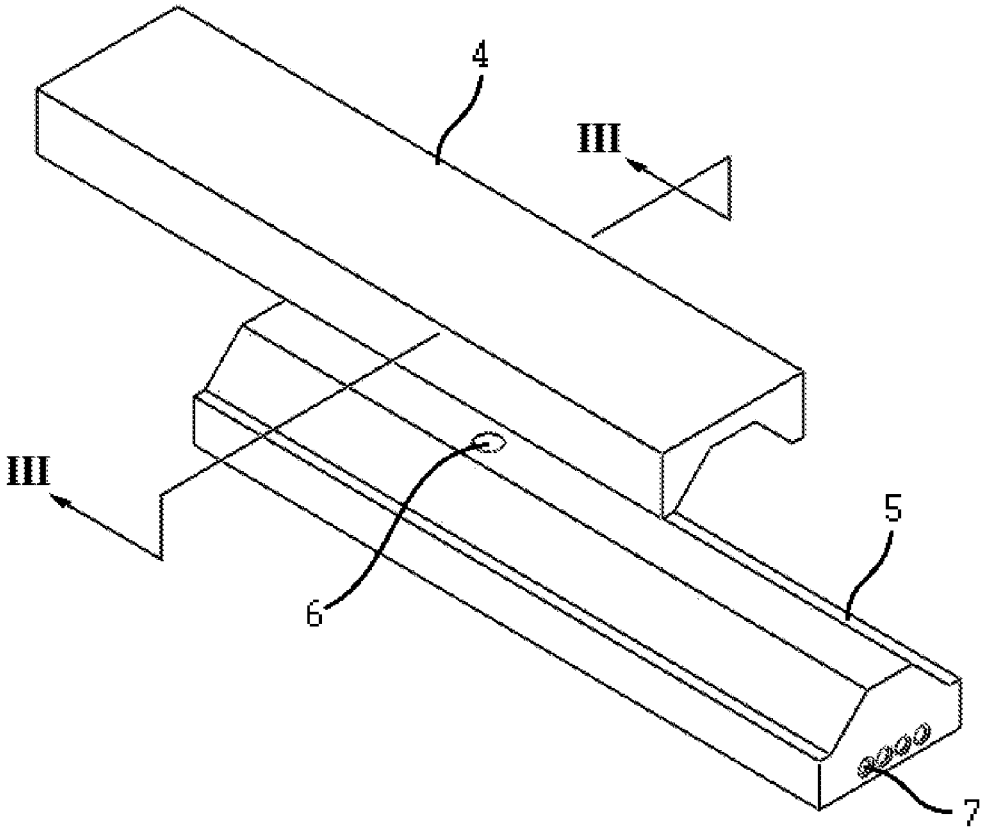
FIG. 2 is a schematic perspective of the magnetic sliding modules according with present invention.

The control system is based in a closed loop control, the elevation of levitation being measured through a sensor 6, which measures the clearance between door and window and its frame, preferably installed on each fixed module 5, as can be seen in FIG. 2.

The set of sensors F provide the clearance measure of the door and window to the control system C, the command the power control system D being allowed in such a way that the programmed elevation is guarantied. In turn, the power control system D converts the information from the control system C in electric current for supplying to the coils 11 of the electromagnets 13.

As the working zone of the door and window is quite bigger than the width of the door and window, it is not required to activate all the modules to levitate the door and window, being only required to activate the modules 5 that are in the zone of the door and window. When the window moves, the management of the activation of the system of the modules and activates the modules 5 required to the displacement, and deactivates those which are not required, which results in greater energy efficiency of the system.

As this system is modular, each module 5 presents a set of four female electric connectors 7 at one end, as can be seen in FIG. 2, and four male electric connectors 8 at the other end, as can be seen in FIG. 4, allowing to create a control bus for several modules 5, all the modules laying parallel to the control system.

In a preferred embodiment, it is described a electromagnetic levitation and sliding system for sliding doors or windows, based on a system of magnetic modules 4 and of electromagnetic modules 5 which are driven by an electronic control system through the electromagnetic field created, which provides the levitation and sliding of the door and window system. The levitation and sliding system is characterized in that it further comprises the following elements:

a) at least a magnetic module 4, where are mounted a set of permanent magnets 9*a*, 9*b* and 12*a*, which produces a constant magnetic field;

b) several electromagnetic modules 5, in each one being a set of permanent magnets 9*c* and 12*b*, intercalated with electromagnets 13, which produce a controllable magnetic field;

c) at least a clearance sensor 6, inserted in each fixed module 5;

d) at least a female electric connector 7 and several male electric connectors;

e) at least an electronic control system.

In a preferred embodiment, the system is modular, the use of several modules 5 allowing the definition of the sliding total length of the door and window, as well as the use of several modules 4 allowing implementing the system in doors or windows of any dimension.

In a preferred embodiment, the system is characterized in that the permanent magnets 9*a*, 9*b* and 12*a*, mounted in the module 4, are arranged along two parallel rows with a distance between magnets, which could vary according to the features of the doors or windows.

In a preferred embodiment, the system is characterized in that the permanent magnets 9*c* and 12*b* and the electromagnets 13, mounted in the module 5, are arranged along two parallel rows with a distance between magnets which could vary according to the features of the doors or windows.

In a preferred embodiment, the system is characterized in that the upper ends of the permanent magnets 9*c* and 12*b* and of the electromagnets 13 mounted in the module 5 and the lower ends of the permanent magnets 9*a*, 9*b* and 12*a* mounted in the module 4 present the same magnetic pole, which provides the repulsion of the modules.

In a preferred embodiment, the system is characterized in that the ends of the magnets 9*a*, 9*b*, 12*a*, 9*c* and 12*b* and of the electromagnets 13 present an orientation of 45° in relation to the horizontal axis, this angle being able to vary between 30° and 60° according to the dimensions and features of the door and window where this system will be implemented.

In a preferred embodiment, the system is characterized in that the electric connection of the several electromagnets having a net shape, the power activation circuit and being inserted in the module itself, which results in the reduction of the number of required connections between the modules 5.

In a preferred embodiment, the circuit comprises a derivative integral proportional controller with a sensor which allows measuring the clearance between the two modules and activating the electromagnets in order to guarantee that the sliding door and window 1*a*, 1*b*, 2 maintain a certain levitation clearance.

In a preferred embodiment, the system is characterized in that the control of the levitation clearance of the sliding door and window 1*a*, 1*b*, 2 is based on a closed loop control model.

In a preferred embodiment, the system is characterized in that the control system can be directly supplied by the mains, or by another alternative energy source.

In a preferred embodiment, the system is characterized in that a control of the activation for several modules is done only in the zone where is positioned the door and window with the purpose to lower energy consumption.

In a preferred embodiment, the system is characterized in that the magnetic closure of the door and window is allowed by the inversion of the magnetic poles of the electromagnets 13.

In a preferred embodiment, the system is characterized by deactivate all the modules when the door and window is in rest condition.

In a preferred embodiment, the system is characterized in that it can to be applied for the movement of another type of objects which operate by sliding.

The described embodiments can be combined there between. The following claims describe additional embodiments of the invention.

The invention claimed is:

1. Magnetic levitation system for a sliding door or sliding window, comprising:

a movable module for a lower part of a sliding door or window, the sliding door or window having a movable frame slidable within a fixed frame, the movable module comprising at least one permanent magnet and the movable frame of the door or window;

a plurality of fixed modules for the fixed frame, each of the plurality of fixed modules comprising one or more electromagnets for producing a variable magnetic field repulsive of the magnetic field of said magnets of the movable module;

at least a clearance sensor, inserted in each fixed module and placed between the movable frame and the fixed frame;

at least two electric connectors;

at least one electronic control system; and a control unit designed to maintain a predefined clearance between the movable frame and the fixed frame by controlling the power supplied to the two or more electromagnets;

wherein the distance between a fixed module and the movable module varies between 1 mm and 10 mm; and wherein the control unit is configured to activate and deactivate the plurality of electromagnets of the plurality of fixed modules on a module by module basis.

2. System according to claim 1, wherein the movable module presents a truncated inverted V profile and the plurality of fixed modules presents a truncated V profile.

3. System according to claim 1, wherein the plurality of fixed modules additionally comprises one or more permanent magnets which magnetic field is oriented for repulsion of the magnetic field of the magnets of the movable module.

4. System according to claim 1, wherein the magnets of the movable module are arranged on two lateral parallel rows along the lower part of the sliding door or window, and wherein the magnets of the movable module are arranged in the same magnetic direction.

5. System according to claim 1, wherein the electromagnets, or electromagnets and magnets, of the plurality of fixed modules, are arranged on two lateral parallel rows along the fixed frame, and wherein the magnets of the plurality of fixed modules are arranged in the same magnetic direction.

6. System according to claim 5, wherein from one of the two said rows of the plurality of fixed modules is a row of electromagnets and the other row is of magnets.

7. System according to claim 5, wherein the magnetic poles of said rows of the plurality of fixed modules, for repulsion of the movable module, are arranged at an acute angle in relation to the vertical axis of the sliding door or window.

8. System according to claim 4 wherein the magnetic poles of said lines of the movable module, for repulsion of the plurality of fixed modules, are arranged at an obtuse angle in relation to the vertical axis of the sliding door and window.

9. System according to claim 7, wherein said angle varies between 30° and 60° in relation to the horizontal axis.

10. System according to claim 1, wherein the control unit is designed to deactivate the plurality of electromagnets when the movement of the movable frame is not required or when it is intended for locking of the sliding of the movable frame.

11. System according to claim 1, wherein the control unit is designed to activate the one or more electromagnets of a fixed module when the fixed module and the movable module are overlapped.

12. System according to claim 1, wherein the control unit is designed to activate the one or more electromagnets of a fixed module for inversion of the polarity of the fixed module so that the repulsion is suppressed when locking of the sliding of the sliding door or window is required and not suppressed when the one or more electromagnets of the fixed module are deactivated.

13. System according to claim 1, wherein the system comprises a plurality movable modules.

14. System according to claim 13, wherein the plurality of fixed modules and the plurality of movable modules are interconnected by a data web.

* * * * *